US006620269B1

(12) United States Patent
Canterberry et al.

(10) Patent No.: US 6,620,269 B1
(45) **Date of Patent: *Sep. 16, 2003**

(54) AUTOIGNITION FOR GAS GENERATORS

(75) Inventors: J B Canterberry, Apollo Beach, FL (US); Kalpesh J. Patel, Lakeland, FL (US); Lennox Lange, Lakeland, FL (US)

(73) Assignee: Breed Automotive Technology, Inc., Lakeland, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 267 days.

(21) Appl. No.: 09/670,072

(22) Filed: Sep. 26, 2000

(51) Int. Cl.[7] ..... C06B 25/18
(52) U.S. Cl. ..... 149/96; 280/736
(58) Field of Search ..... 149/96; 280/736, 280/741

(56) References Cited

U.S. PATENT DOCUMENTS

| | | | | | |
|---|---|---|---|---|---|
| 2,358,886 | A | | 9/1944 | Sullivan | 36/76 |
| 2,967,098 | A | * | 1/1961 | Weil | 52/5 |
| 3,364,086 | A | * | 1/1968 | Oversohl et al. | 149/2 |
| 3,676,533 | A | * | 7/1972 | Dehm et al. | 264/3 |
| 4,052,941 | A | * | 10/1977 | Morrow | 102/39 |
| 4,054,095 | A | * | 10/1977 | Morrow | 102/39 |
| 4,092,188 | A | * | 5/1978 | Cohen et al. | 149/19.4 |
| 4,120,920 | A | * | 10/1978 | Cougal et al. | 264/3 |
| 4,561,675 | A | | 12/1985 | Adams et al. | 280/734 |
| 4,858,951 | A | | 8/1989 | Lenzen | 280/741 |
| 5,187,320 | A | * | 2/1993 | Yunan | 102/275.8 |
| 5,468,017 | A | * | 11/1995 | Kirsch et al. | 280/741 |
| 5,679,915 | A | * | 10/1997 | Hamilton et al. | 86/20.1 |
| 5,834,679 | A | * | 11/1998 | Seeger | 102/288 |
| 6,241,833 | B1 | * | 6/2001 | Brown | 149/19.8 |

FOREIGN PATENT DOCUMENTS

| | | |
|---|---|---|
| DE | 38 38 646 A1 | 5/1990 |
| DE | 196 23 112.4 | 12/1996 |
| JP | 59046420 A | 3/1984 |

* cited by examiner

*Primary Examiner*—Michael J. Carone
*Assistant Examiner*—Aileen B. Felton
(74) *Attorney, Agent, or Firm*—JarettRieger

(57) ABSTRACT

When a vehicle is involved in a fire, the airbag inflator is subjected to extreme temperatures, which may lead to the housing of the inflator rupturing. The use of autoignition material will minimize the risk of the housing rupturing during a fire by causing the combustion of the gas generant to occur at a desired safe temperature. According to the present invention, the autoignition material contains nitrocellulose material and an inert plasticizer. The plasticizer creates an autoignition material that is thermally stable and that does not need to undergo preassembly or packaging before being placed in a gas inflator.

6 Claims, 1 Drawing Sheet

AUTOIGNITION FOR GAS GENERATORS

FIELD OF THE INVENTION

The present invention relates generally to gas generators used to inflate vehicle airbags, and specifically, to the autoignition of gas generating or ignition enhancer materials.

BACKGROUND OF THE INVENTION

Inflatable occupants restraint systems have been developed to protect vehicle occupants in the event of a crash by rapidly inflating a cushion or bag between a vehicle occupant and the interior of the vehicle. An inflated airbag reduces the injury sustained by a vehicle occupant during a crash by having the vehicle occupant collide with an inflatable cushion rather than the hard surfaces of the interior of the vehicle. The inflatable cushion or airbag absorbs much of the vehicle occupant's energy during a crash to provide the vehicle occupant with a gradual and controlled deceleration during a crash.

A typical method for inflating an airbag is with a gas generator that generates gas by an exothermic reaction of a fuel and an oxidizer. During a crash of a significant magnitude an electrical signal from one or more crash sensing devices is sent to an inflator igniter. The initiation of the igniter starts a string of chemical reactions in the inflator, in which gas for inflating the airbag is rapidly produced.

The inflator may be subjected to abnormally high temperatures, for example if the inflator is involved in a fire during shipment. During a vehicle fire, the strength and structural integrity of the housing will be diminished. As the temperature increases, the burn rate for the pyrotechnic material increases which will cause the chamber pressure to also increase. Moreover, at elevated temperatures, the gas generant can melt or decompose and become unstable which can result in loss of ballistic control resulting in over pressurization. Therefore, if a vehicle is involved in a fire, the ignition of the gas generant composition can lead to overpressurization and loss of ballistic control, which could result in structural failure of the inflator housing.

To overcome the potentially dangerous situation of housing failure, autoignition materials are used which spontaneously combust or ignite at a temperature lower than that which would lead to the failure of the inflator housing due to over pressurization. When the autoignition material spontaneously ignites, the generated heat ignites the gas generant or ignites a booster material, and the inflator functions normally. Thus, the gas generating material is ignited when a preselected temperature is reached, which is below the temperature that would cause the gas generating material to behave in an unpredictable manner.

The number of autoignition compositions available in the prior art is limited, and in part includes nitrocellulose and mixtures of potassium chlorate and sugar. Smokeless powder or gunpowders are nitrocellulose based substances that autoignite at approximately 177° C. (≈350° F.) A problem with using gunpowders for autoignition materials is that these materials are granular and need to be packaged before being placed in the inflator. The packaging of the nitrocellulose-based material into an autoignition container complicates the manufacturing process by adding an additional sub-process step.

DISCUSSION OF THE PRIOR ART

U.S. Pat. No. 4,561,675 teaches an autoignition material located in a container adjacent to the inflator. The autoignition material is a smokeless powder that ignites at approximately 176° C. (350° F.). In the preferred embodiment, the smokeless rifle powder is IMR 4895, which is largely composed of nitrocellulose.

U.S. Pat. No. 4,858,951 teaches small grains of an autoignition material physically mixed with a booster material, such that at a predetermined temperature, the autoignition material will spontaneously ignite. This event will cause the booster material to ignite which will in turn ignite the gas generant. The preferred autoignition material is smokeless powder, and the booster material is a mixture of boron potassium nitrate, titanium hydride, and potassium perchlorate.

SUMMARY OF THE INVENTION

The present invention is directed to an autoignition material for igniting a gas generant at a preselected temperature. The autoignition material comprises 70%–95% by weight nitrocellulose and 5%–30% by weight inert plasticizer and is not smokeless powder. Upon exposure of the inflator housing to excessive heat, the autoignition material spontaneously ignites the booster material or gas generant, which in turn safely deploys the inflator.

An advantage of the present invention is that the autoignition material is a monolithic grain, rather than a granular material. Utilizing a monolithic autoignition material is a significant reduction in manufacturing cost since a subassembly of an autoignition material is not required. The monolithic grain in the claimed invention does not need to be packaged and can be directly installed in the inflator housing.

BRIEF DESCRIPTION OF THE DRAWING

Further features of the present invention will become apparent to those skilled in the art to which the present invention related from reading the following specification with reference to the sole FIGURE of the accompanying drawing which is a cross section of a gas-generating device.

DETAILED DESCRIPTION OF THE INVENTION

Figure 1:
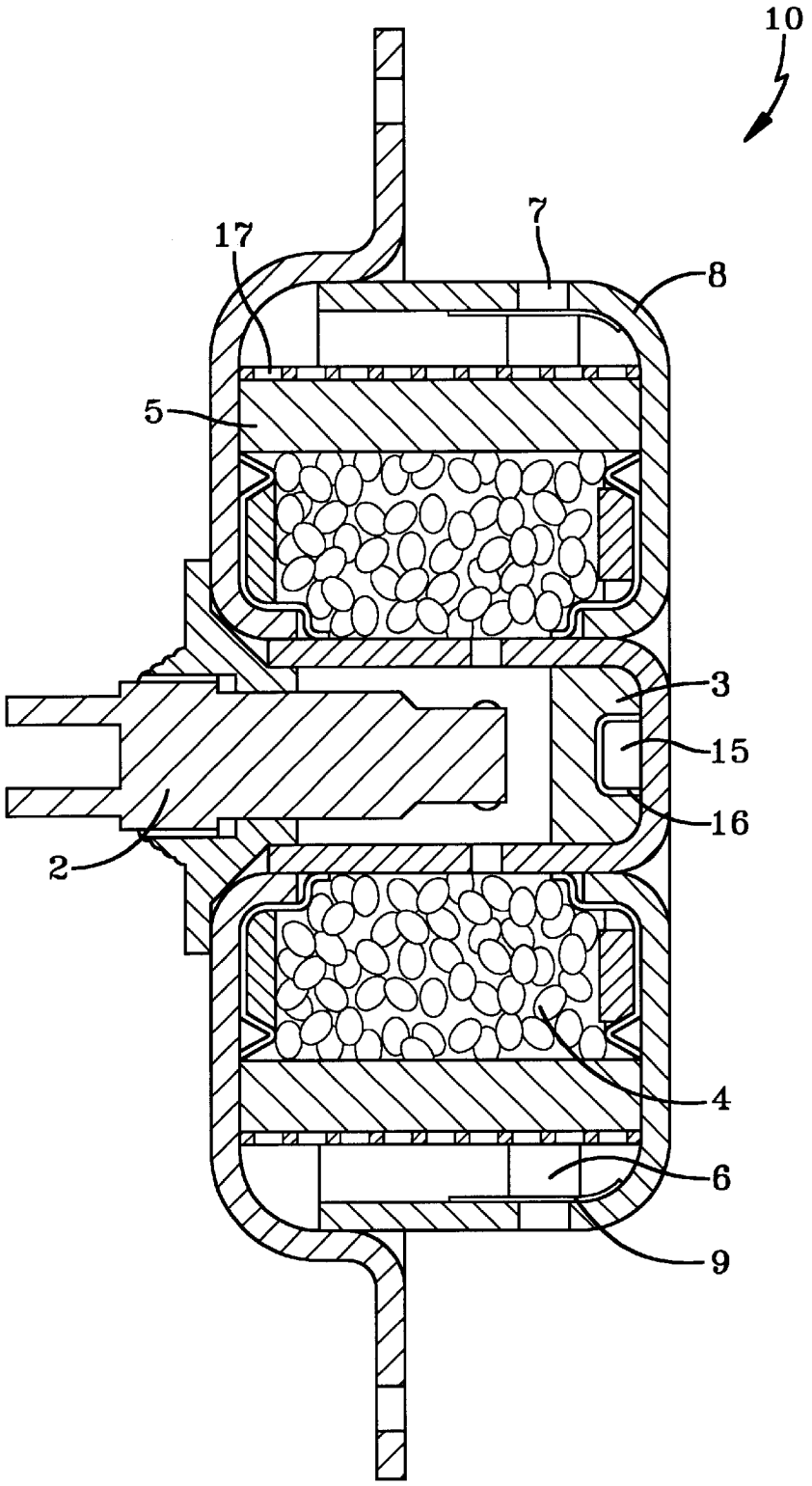

A cross section of an exemplary pyrotechnic inflator 10 is shown in FIG. 1. An electric signal from one or more crash sensing devices (not shown) is sent to an igniter, or squib, 2. As used herein, a "squib" is understood to be an electrical device having two electrodes insulated from one another and connected by a bridge, such as a wire or semiconductor bridge. Typically, the bridge wire is embedded in one or more layers of a pyrotechnic composition designed to produce sufficient energy upon activation to ignite a booster composition 3. It is understood that various electrical, electronic, mechanical, and electromechanical initiators are known in the art and can be used in the present invention. When activated, the igniter ignites the booster or enhancer that in turn ignites the gas generant. The gas generant formulations comprise a fuel and an oxidizer. The fuel can be selected from a group comprising of sodium azide, tetrazoles (i.e. -aminotetrazole), the bitetrazoles, mineral salts of tetrazoles, 1,2,4-triazole-5-one, guanidine nitrate, nitroguanidine, aminoguanidine nitrate, and the like. A host of oxidizers can be utilized in the present invention, some of which include alkali metal and alkaline earth metal nitrates, chlorates, oxides, perchlorates, and ammonium nitrate.

The gas produced from the chemical reaction of the gas generant passes through a knitted wire filter 5 and a perforated tube 17 and then enters an annular chamber 6. Apertures 7 in the metal housing 8 are sealed with a stainless steel burst foil 9. The housing for the inflator can be made from steel, aluminum, aluminum alloys, stainless steels, and the like. Inflator housings are commonly made from metal, however those skilled in the art will appreciate that other materials such as plastics, ceramics, composites, and the like can be used to fabricate the housing. When the pressure inside the inflator passes a certain level the foil 9 bursts and the gas exits the inflator. The gas travels to an airbag (not shown), causing the airbag to inflate. However, it is understood that the autoignition material disclosed herein may be employed in any suitable inflator hardware.

An autoignition material 15 is disposed in close proximity to the booster composition 3 or in some cases the gas generant 4. The autoignition material is a material that will spontaneously combust at a preselected temperature and thereby ignite the booster composition or gas generant resulting in the safe functioning of the gas generant at elevated temperatures. Thus, the gas generant may be ignited by two separate pathways, which include the igniter and the autoignition material. The advantage of deploying an airbag during fires is to control the combustion of the gas generant so that the inflator can deploy safely. Without the presence of an autoignition material, the gas generants can ignite at a dangerously high temperature and rupture the housing of the inflator. An autoignition retainer 16 secures the autoignition material 15 against the interior wall of the metal housing 8 to assure proper heat transfer occurs so that an autoignition material ignites at the desired temperature.

The autoignition material of the present invention can be utilized in driver side airbag inflators, passenger side airbag inflators, side impact inflators, pretensioners, and any other gas generator. Furthermore, the autoignition material can spontaneously ignite the booster composition in a pyrotechnic inflator as well as in a hybrid inflator. Inflators with the autoignition composition according to the present invention are safe to transport and meet the U.S.A. Department of Transportation shipping requirements.

The autoignition material of the present invention comprises a mixture of 70–95% by weight nitrocellulose and 5–30% by weight inert plasticizer. The inert plasticizer comprises one or more of the following chemicals: acetyl triethyl citrate, dioctyl phthlate and dibutyl phthlate. In operation, the autoignition material will spontaneous ignite or combust at a temperature range of 175–195° C. The autoignition material is thermally stable even when exposed to a wide range of temperatures. Also, nitrocellulose will autoignite if moisture is present in the inflator.

The autoignition material of the present invention is a safe monolithic material and does not require packaging before being added to the gas inflator. The autoignition material is not granular or a powder. Since the autoignition material is one grain, it can be prepared to a desired size and shape and hence does not require a sub-assembly step or special handling prior to installation into the airbag inflator. For the present invention, the starting material is purchased from EXPRO Chemical Products Inc.

The autoignition material of the present invention differs from smokeless gunpowder. The autoignition material of the present invention has a lower energy than smokeless powder as well as having a digressive burning characteristic. Single base gunpowder is typically greater than 98% nitrocellulose, while the autoignition material in the present invention consists of about 84% nitrocellulose and the remainder is non-energetic. Also, single base gun powder is a powder or granular substance and needs to be prepackaged before being placed in the airbag inflator. The addition of inert plasticizer to the nitrocellulose eliminates the necessity of packaging the autoignition material.

EXAMPLE I

The composition of the autoignition material is set forth in Table 1.

TABLE 1

| Description | Quantity (by weight) |
|---|---|
| Nitrocellulose | 83.85% ± 1.0% |
| Acetyl Triethyl Citrate | 15.0% ± 0.5% |
| Diphenylamine | 1.0% ± 0.2% |
| Carbon Black | 0.15% (maximum) |
| Residual Solvents | 2.7% (maximum) |
| Moisture | 1.5% (maximum) |

EXPRO Chemical Products Inc prepared the autoignition pellets by combining all of the chemicals from Table 1, and then extruding the material into autoignition pellets with the shape of right circular cylinders. The pellets were not perforated and had an average weight of 0.070 g±0.010 g. The autoignition pellets were purchased from EXPRO Chemical Products Inc.

Since the autoignition pellet from EXPRO is a monolithic grain, it was directly placed in an autoignition retainer. The autoignition retainer was then pressed into the bottom of a fully assembled pyrotechnic inflator.

From the above description of a preferred embodiment, those skilled in the art will perceive improvements, changes, and modifications. Such improvements, changes, and modifications are considered to be within the spirit and scope of the present invention as disclosed in the foregoing description and defined by the appended claims.

We claim:

1. An autoignition composition for igniting a gas generant in an inflator consisting essentially of a mixture of a. about 70–95% by weight of nitrocellulose and b. about 5–30% by weight of inert plasticizer, wherein the plasticizer is selected from the group consisting of acetyl triethyl citrate, dioctyl phthlate and dibutyl phthlate, wherein the autoignition composition autoignites between 175 and 195° C., has a digressive burning characteristic, and is a monolithic grain.

2. The autoignition composition according to claim 1, wherein said autoignition composition can be directly installed into a gas generator.

3. The autoignition composition according to claim 1, wherein said autoignition composition makes contact with an interior wall of a gas generator.

4. The autoignition composition according to claim 1, wherein said autoignition composition is in close proximity to a booster composition.

5. The autoignition composition according to claim 1, wherein said autoignition composition is in close proximity to a gas generant.

6. The autoignition composition according to claim 1, wherein said autoignition composition spontaneously combusts at a temperature less than the temperature that will cause a gas generant to autoignite.

* * * * *